US005795138A

United States Patent [19]

Gozdawa

[11] Patent Number: 5,795,138

[45] Date of Patent: Aug. 18, 1998

[54] COMPRESSOR

[76] Inventor: Richard Gozdawa, 2 Shortbridge Street, Newtown, Powys, United Kingdom

[21] Appl. No.: 399,509

[22] Filed: Mar. 7, 1995

Related U.S. Application Data

[63] Continuation-in-part of PCT/GB93/01900, Sep. 8, 1993.

[30] Foreign Application Priority Data

| | | | |
|---|---|---|---|
| Sep. 10, 1992 | [GB] | United Kingdom | 9219167 |
| Mar. 8, 1994 | [GB] | United Kingdom | 9404436 |

[51] Int. Cl.[6] ..... F04B 17/03

[52] U.S. Cl. ..... 417/243; 417/366; 417/423.12

[58] Field of Search ..... 417/243, 350, 417/365, 366, 423.7, 423.8, 423.12

[56] References Cited

U.S. PATENT DOCUMENTS

| | | | |
|---|---|---|---|
| 3,119,343 | 1/1964 | White | 417/423.12 |
| 3,133,693 | 5/1964 | Holl | 230/116 |
| 3,174,680 | 3/1965 | Young | 230/127 |
| 3,584,973 | 6/1971 | Lambiris | 417/13 |
| 3,664,758 | 5/1972 | Sato | 417/365 |
| 3,933,416 | 1/1976 | Donelian | 417/354 |
| 4,125,345 | 11/1978 | Yoshinaga et al. | 417/243 |
| 4,204,810 | 5/1980 | Vogel | 417/350 |
| 4,407,631 | 10/1983 | Schneider et al. | 415/216.1 |
| 4,558,228 | 12/1985 | Larjola | 290/52 |

FOREIGN PATENT DOCUMENTS

| | | |
|---|---|---|
| 0 150 599 | 8/1985 | European Pat. Off. . |
| 82 09771 | 12/1983 | France . |
| 0 297 691 | 6/1987 | France . |
| 25 41 715 | 4/1976 | Germany . |
| 0 087 197 | 2/1982 | Germany . |
| 0 232 546 | 12/1986 | Germany . |
| 0 305 700 | 7/1988 | Germany . |
| 3121306 | 5/1991 | Japan . |
| 815923 | 7/1959 | United Kingdom . |
| 1192354 | 5/1970 | United Kingdom . |
| 1 510 019 | 9/1975 | United Kingdom . |
| 1 512 381 | 6/1978 | United Kingdom . |
| 2 018 893 | 3/1979 | United Kingdom . |
| 2 120 321 | 3/1983 | United Kingdom . |
| 2 206 157 | 6/1988 | United Kingdom . |
| WO91/09230 | 6/1991 | WIPO . |
| WO94/05913 | 3/1994 | WIPO . |

OTHER PUBLICATIONS

"Production of Oil Free Compressed Air with High Speed Technology" by Peussa, Helsinki Univ. of Technology, Helsinki, Finland, undated.

*Primary Examiner*—Timothy Thorpe
*Assistant Examiner*—Peter G. Korytnyk
*Attorney, Agent, or Firm*—David P. Gordon; Thomas A. Gallagher; David S. Jacobson

[57] ABSTRACT

A compressor includes impeller rotors, a rotatable shaft upon which the impeller rotors are mounted, and tilting pad journal bearings having a ceramics bearing surface. The rotatable shaft is journalled by the tilting pad journal bearings which is arranged to be self generating and air or gas lubricated. The tilting pad self generating bearings reduce frictional losses and the ceramics bearing surfaces prevent problems commonly caused by high speed and temperature generated at bearings.

10 Claims, 4 Drawing Sheets

COMPRESSOR

This application is a continuation-in-part of PCT application GB93/01900 dated 8th Sept. 1993.

BACKGROUND OF THE INVENTION

The present invention relates to a compressor.

When processing food, pharmaceutical and other sensitive material it is desirable to have a supply of compressed air or other working gas which is absolutely clean or "dry", that is to say completely free of oil or other bearing lubricating material.

In the past, there have been many attempts to produce oil-free compressors, but constructions such as dry screw compressors are expensive, inefficient, use large amounts of power and are cumbersome.

The overall market for air compressors comprises a number of performance bands with each performance band encompassing in combination a range of delivery pressures and a range of mass flows.

A delivery pressure of around 8.5 bara combined with a mass flow of 0.27 kg per second is within one of the market bands for a dry air compressor. Delivery pressures can be met without difficult at the present time, but the mass flow from a conventional turbo compressor of this sort is far greater than the mass flow which is required.

In addition, turbo compressors mounted on known oil lubricated, roller or ball journal bearings would be prohibitively inefficient at the high shaft rotational speeds (typically 50,000 to 100,000 rpm) required for the desired performance. Known turbo compressors operating in this band would therefore be extremely expensive, large and inefficient.

SUMMARY OF THE INVENTION

According to a first aspect, the invention provides a compressor comprising a rotatable shaft, drive means arranged to rotate the shaft, at least one impeller rotor stage mounted on the shaft, and journal bearing means comprising at least one tilting pad journal bearing arranged to be self generating and air or gas lubricated.

The provision of a journal bearing as defined enables the high rotational speed of the compressor to be achieved without excessive frictional losses in the journal bearings and prevents consequential overheating thereof.

Desirably, the tilting pads of the journal bearing are provided with a ceramics bearing surface which reduces problems which may otherwise be caused by material expansion (due to high operational temperatures) of the shaft and bearing between which clearances are extremely small in practice.

According to a second aspect, the invention provides a compressor comprising a rotatable shaft, drive means arranged to rotate the shaft, at least one impeller rotor stage mounted on the shaft and thrust bearing means provided for the shaft, the thrust bearing means arranged to act directly on the impeller rotor stage.

This enables heat generated at the thrust bearing means to be transferred via the impeller rotor stage directly to the working gas of the compressor, thereby cooling the bearing means and inhibiting overheating.

According to a third aspect, the invention provides a compressor comprising a rotatable shaft, drive means arranged to rotate the shaft, at least one impeller rotor stage mounted on the shaft and bearing means provided for the shaft, in which at least a portion of the rotatable shaft is substantially hollow.

This reduces the rotational moment of inertia of the combined impeller rotor stage and shaft assembly, thereby reducing the work needed to rotate the shaft and hence improving efficiency.

Desirably, the compressor according to the first aspect of the invention is provided with a thrust bearing according to the second aspect of the invention and/or the hollow shaft according to the third aspect of the invention.

Preferably, the thrust bearing means is arranged to act directly on the impeller rotor stage such that when the shaft rotates, bearing contact is made between the thrust bearing and a bearing surface of the impeller rotor stage.

It is preferred that the compressor is provided with direct drive means arranged to rotate the shaft at high rotational speeds preferably in the range 50,000 to 100,000 rpm. Preferably, the drive means therefore comprises an electric motor having a rotor mounted on the shaft.

Desirably the compressor is multi-stage and preferably comprises at least two impeller rotor stages, which are advantageously mounted on longitudinally spaced portions of the shaft, preferably such that the electric motor is positioned between the rotor stages. It is preferred that thrust bearing means is arranged to act directly on at least two impeller rotor stages to take up axial forces in opposed axial directions of the shaft.

It is preferred that compressed air or working gas from a relatively higher pressure impeller rotor stage is bled back toward a relatively lower pressure stage internally along a hollow portion of the shaft. This is advantageous because the shaft is effectively cooled which results in further heat dissipation from the bearings. Desirably, a bleed passage in communication with the hollow portion of the shaft is provided for this purpose.

Desirably, intercooler means is provided intermediate impeller rotor stages to enhance the efficiency of the compressor.

Desirably, the shaft comprises a composite shaft comprising the hollow rotor portion intermediately connecting spaced portions of the shaft, the spaced portions of the shaft desirably carrying respective impeller stages. Advantageously the hollow rotor portion of the shaft is of a magnetic or magnetisable material. By making the rotor portion of the shaft hollow, the mass (and hence the moment of inertia about the axis) of the composite shaft is kept to a minimum.

Advantageously securing means is provided for securing the hollow rotor portion and spaced portions of the shaft relative to one another. Preferably the securing means comprises a tie rod passing through the hollow rotor portion and the connected spaced portions of the shaft.

It is preferred that thrust bearing means are provided to act on impeller stages at both spaced portions of the shaft arranged such that axial thrust of the shaft in mutually opposed axial directions is taken up.

Desirably the thrust bearing means is arranged to act on the respective impeller stage rotor such that heat generated at the bearing is transferred to the impeller stage rotor. The thrust bearing means and the respective impeller are therefore preferably arranged to be in thermally communicative bearing contact when the compressor is operational.

This ensures that heat generated at the thrust bearing means is transferred to the respective impeller and subsequently to the working gas passing through the respective impeller stage of the compressor. The gas is then cooled as it passes into the following intercooler means.

It is preferred that a compressor according to the second and/or third aspects of the invention further comprises journal bearing means arranged to support the shaft, preferably comprising at least one tilting pad journal bearing advantageously arranged to be self generating and air or gas lubricated and desirably having bearing pads provided with a ceramics bearing surface. The bearing pads may comprise homogenous pads of ceramics material.

It is preferred that the shaft is provided with hardened or ceramics surface portions against which the ceramics bearing surface of the respective tilting pads of the journal bearing means is arranged to act.

Advantageously the bearing means comprises at least two journal bearings, each preferably being tilting pad journal bearings arranged to be air or gas lubricated and having bearing pads provided with respective ceramics bearing surfaces. Alternatively foil journal bearings may be used. Desirably, the journal bearings are provided to support spaced portions of the shaft advantageously adjacent opposed ends of the electric motor. It is preferred that at least one journal bearing is provided intermediately between a respective end of the motor and a respective impeller rotor stage.

The thrust bearing means preferably comprises a thrust bearing having tilting pads acting against the impeller rotor stage. Desirably the thrust bearing is of a self-generating air-or gas-lubricated type, having pads provided with ceramics bearing surfaces.

Advantageously, the impeller rotor stages are overhung at opposed ends of the shaft. It is preferred that each impeller rotor stage comprises a respective compressor impeller, with intercooler means being communicatively connected intermediate the impeller rotor stages.

Desirably, three impeller rotors are provided such that the compressor comprises three compression stages. It is preferred that respective intercooler means is provided intermediately between successive compressor stages. This improves the efficiency of the compressor. Advantageously, the flow of working gas into each respective impeller rotor is axial, and preferably in the direction of the electric motor.

It is accordingly preferred that at least two of the impeller stages are arranged in reverse formation relative to one another such that the respective flows into the respective impeller stages are in opposed directions, preferably towards one another. This has the advantage that the axial thrust load applied to the shaft by the respective impeller stages tend to cancel each other out, thereby reducing the axial thrust taken up by the thrust bearing means.

It is preferred that seal means, preferably comprising respective labyrinth seals, are provided for the shaft, arranged to inhibit access of the working gas from the impeller rotor stages to the motor and bearing means.

Advantageously, the electric motor comprises an electromagnetic or permanent magnet electric motor, preferably arranged to rotate the shaft at over 50,000 r.p.m. and more preferably at over 70,000 r.p.m. Desirably the electric motor is a direct current motor, preferably controlled by a variable frequency source.

DESCRIPTION OF THE PREFERRED EMBODIMENTS

Figure 1:
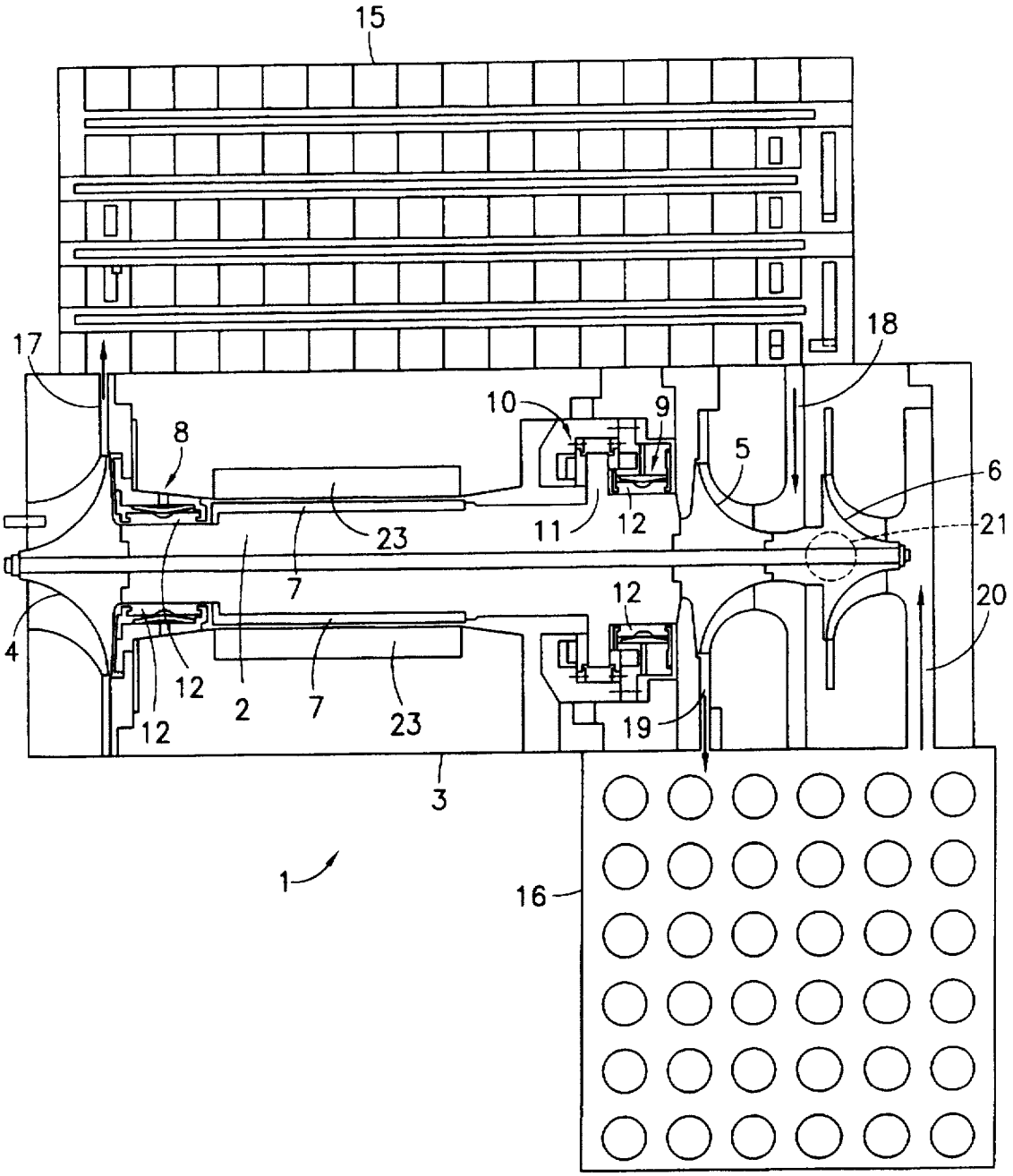
FIG. 1 is a schematic representation of a first embodiment of compressor according to the invention.

Referring to the drawings, there is shown a compressor generally designated 1 which comprises an axial rotatable shaft 2 mounted in a housing 3, and having machined aluminum impeller rotors 4,5,6 mounted thereon.

Intake, first stage, rotor 4 is overhung at one end of the shaft, whereas second and third stage rotors 5 and 6 respectively are overhung at the opposed end. Intermediately between impeller rotors 4 and 5 there is positioned a brushless D.C. motor having a rotor 7 comprising permanent magnets mounted on the shaft 2 and a stator 23 mounted in the housing. A solid state thyristor based inverter/controller (not shown) is used to generate a variable but high frequency current from a standard 415 V/50 Hz electrical supply. The high frequency current drives the motor (and therefore directly drives the shaft 2 without the need for intermediate gearing) at the required high operational speed which is typically of the order of 50,000 to 100,000 r.p.m. Because no gearing is required to couple shaft 2 to the drive, power losses are minimised.

The shaft 2 is supported in housing 3 on journal bearings 8,9 provided at either end of the electric motor, adjacent impeller rotors 4 and 5 respectively. A thrust bearing 10 is also mounted in the housing to act on thrust collar 11 provided on the shaft. Journal bearing 8,9 comprise tilting pad journal bearings which are self generating and air lubricated. The tilting pads 12 of each journal bearing 8,9 are supported on flexible pivots 24, and provided with ceramics bearing surfaces 13 which are arranged to act on immediately adjacent bearing surface portions of the shaft. The bearing surface portions of the shaft are coated with hardened deposit to increase wear resistance.

It is an important feature of the design that frictional losses in the bearings are minimised to maximise the efficiency of the compressor. Typically, where fluid lubricated journal bearings (such as oil lubricated bearings) or ball or roller journal bearings are used in high speed rotating machinery frictional losses in the bearings amount to between 5% and 10% of the driving power. The provision of tilting pad self generating air (or gas) bearings cuts frictional losses to approximately 0.5% of driving power. However due to the fact that the shaft rotation speed is extremely high (e.g. 80,000 r.p.m. for a compression from 1 bara to 8.5 bara at a mass flow of 0.27 kg/s for air) the temperature generated at the bearings is extremely high, which can cause problems with bearing/shaft material expansion due to the necessarily small bearing shaft clearances required for the operation of air or gas lubricate tilting pad self generating journal bearings (typically 0.003" diametral clearance for journal bearings). This problem is overcome by utilising ceramics materials for the bearing surfaces of tilting pads 12; the provision of a hardened deposit surface covering for the bearing portions of the shaft 2 also assists in overcoming this problem.

Thrust bearing 10 is also provided with tilting pad thrust members **10*a*,10*b* provided with ceramics bearing surfaces. Pads 10*a* are arranged to take up normal thrust loading transferred from shaft 2 by thrust collar 11 during normal running of the compressor. Pads 10*b* act on the opposite side of collar 11** and act to take up reverse thrust loading during motor and shaft "run up" to normal operational speed.

To increase efficiency, an intercooler 15 is provided intermediately between first stage impeller 4 and second stage impeller 5. A second intercooler 16 is provided intermediately between second stage impeller 5 and final (third) stage impeller 6. It is an important feature of the compressor that the flow of working gas into the first stage impeller 4 is in an opposed direction to the flow of working gas into the second and third stage impellers 5,6. This has the effect of "balancing" the axial thrust acting on the shaft and reducing the usual axial thrust applied to thrust bearing 10. Bearing losses in thrust bearing 10 are thereby minimised.

In operation, the electric motor is run up to an operating speed of around 80,000 r.p.m. Working gas is then drawn axially into the first impeller stage 4 and forced out through duct 17 into intercooler 15. The working gas leaves intercooler 15 entering duct 18 and subsequently passing axially into second impeller stage 5. The working fluid leaves impeller 5 radially passing via duct 19 into second intercooler 16. Intercoolers 15 and 6 are substantially identical, except that intercooler 16 is arranged with its longitudinal dimension at 90° to the longitudinal dimension of intercooler 15 (i.e. the longitudinal dimension of intercooler 16 is out of the page in FIG. 1).

Working gas leaves intercooler 16 via duct 20 and is directed to enter the third (and final) impeller stage 6 axially. The working gas leaves the final impeller stage 6 radially via outlet duct 21 (the outlet flow through duct 21 is out of the page in FIG. 1).

Due to the combination of the high speed directly driven rotatable shaft, together with the minimisation of bearing losses and the split stage intercooled arrangement of the impeller rotors, an extremely efficient compressor is provided according to the invention. The compressor enables a compact turbomachine to be used in applications previously served mainly by screw feed type compressors since, unusually for a turbo compressor high delivery pressures (8.5 bara typically) are achievable with relatively low mass flows (0.27 kg/s typically for air).

Figure 2:
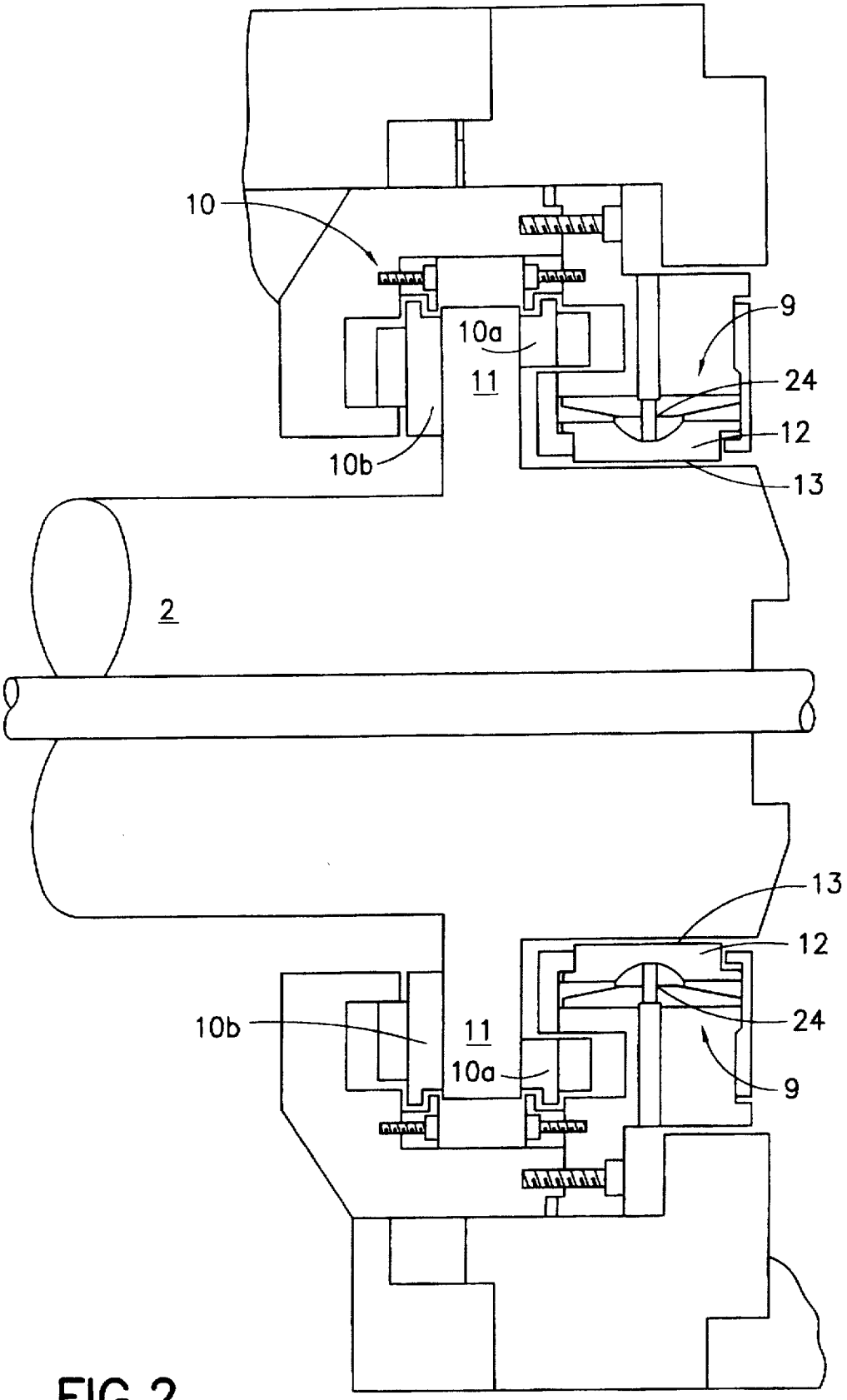
FIG. 2 is an enlarged detail of a part of the compressor of FIG. 1.
Figure 3:
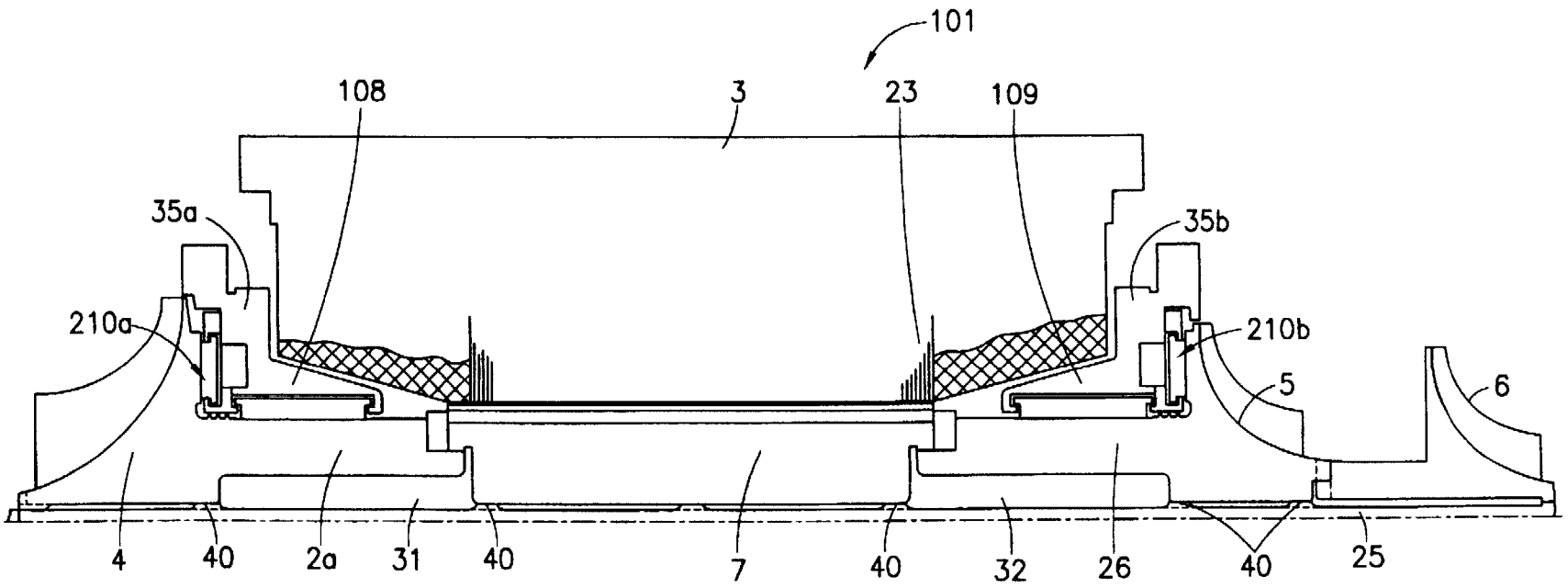
FIG. 3 is a schematic representation of an alternative embodiment of a compressor according to the invention.

Referring to FIG. 3, the embodiment of compressor 101 shown is generally similar to in terms of construction and operation to the arrangement shown in FIGS. 1 and 2, and like reference numerals have been used to identify like components of the compressors.

In the embodiment shown in FIG. 3, the thrust collar 11 of the compressor embodiment shown in FIG. 2 is dispensed with and a pair of spaced thrust bearings 210*a*,210*b* provided adjacent the first and second stage impellers 4,5 respectively to take up axial forces in respectively opposed directions acting on the shaft 2. It has been found that with the compressor shown in FIG. 1, excessive heat is generated at the thrust bearing 10 which results in reduced efficiency in terms of compressor performance and operational life expectancy. By replacing the thrust collar 11 and bearing assembly 10 with thrust bearings 210*a*,210*b* acting directly on the rear substantially flat surfaces of impeller rotor stages 4,5 respectively (as shown in the embodiment of FIG. 3), overheating problems are substantially ameliorated. Heat generated at the thrust bearings 210*a* and 210*b* is transferred directly to the respective impeller stage rotor 4,5 and subsequently to the working gas flowing through the respective impeller stage rotor. The working gas is then cooled by passing through respective intercoolers (not shown in FIG. 3) which are provided intermediate each impeller stage rotor as for the apparatus shown in FIG. 1. Heat is therefore effectively transferred away from the thrust bearings. The thrust bearings 210*a*,210*b* comprise bearing pads 110*a*,110*b* mounted in a respective annular support ring 37*a*,37*b* carried by housings 35*a*,35*b*. The pads may be homogenous ceramics material, or alternatively may be provided with a ceramics bearing surface.

The embodiment of the invention shown in FIG. 3 also differs from the arrangement shown in FIG. 1 in that the shaft effectively comprises a hollow sectioned composite shaft comprising a first shaft portion 2*a* (carrying impeller stage rotor 4), a second shaft portion 2*b* (carrying impeller stage rotor 5), and intermediate motor rotor section 7 extending between shaft portions 2*a* and 2*b*. Shaft portions 2*a* and 2*b* connect with opposed ends of the motor rotor section 7, the whole composite shaft being held together by means of axially extending tie rod 25. First and second shaft portions 2*a*, 2*b* are provided with respective hollow cylindrical cavities 31, 32 intersected by the axis of the shaft.

Tie rod 25 is provided along its length with sets of circumferentially spaced projections 40 which abut internal axial bores of shaft portions 2*a*,2*b* and motor rotor 7. Circumferential spaces intermediate respective projections in each set 40 permit air communication along substantially the entire length of the interior of the composite shaft in the region adjacent tie rod 25. Compressed air or working gas is bled back from relatively higher pressure stage 5 (via bleed communication passage 42) and passes-internally along the length of the composite shaft toward relaively lower pressure stage 4. Passage of the air or transport gas in the internal cavities 31, 32 and along the tie rod cause heat dissipation from the shaft portions 2*a*, 2*b* (and hence bearings 210*a*, 210*b*, 108, 109) and motor rotor 7.

Figure 4:
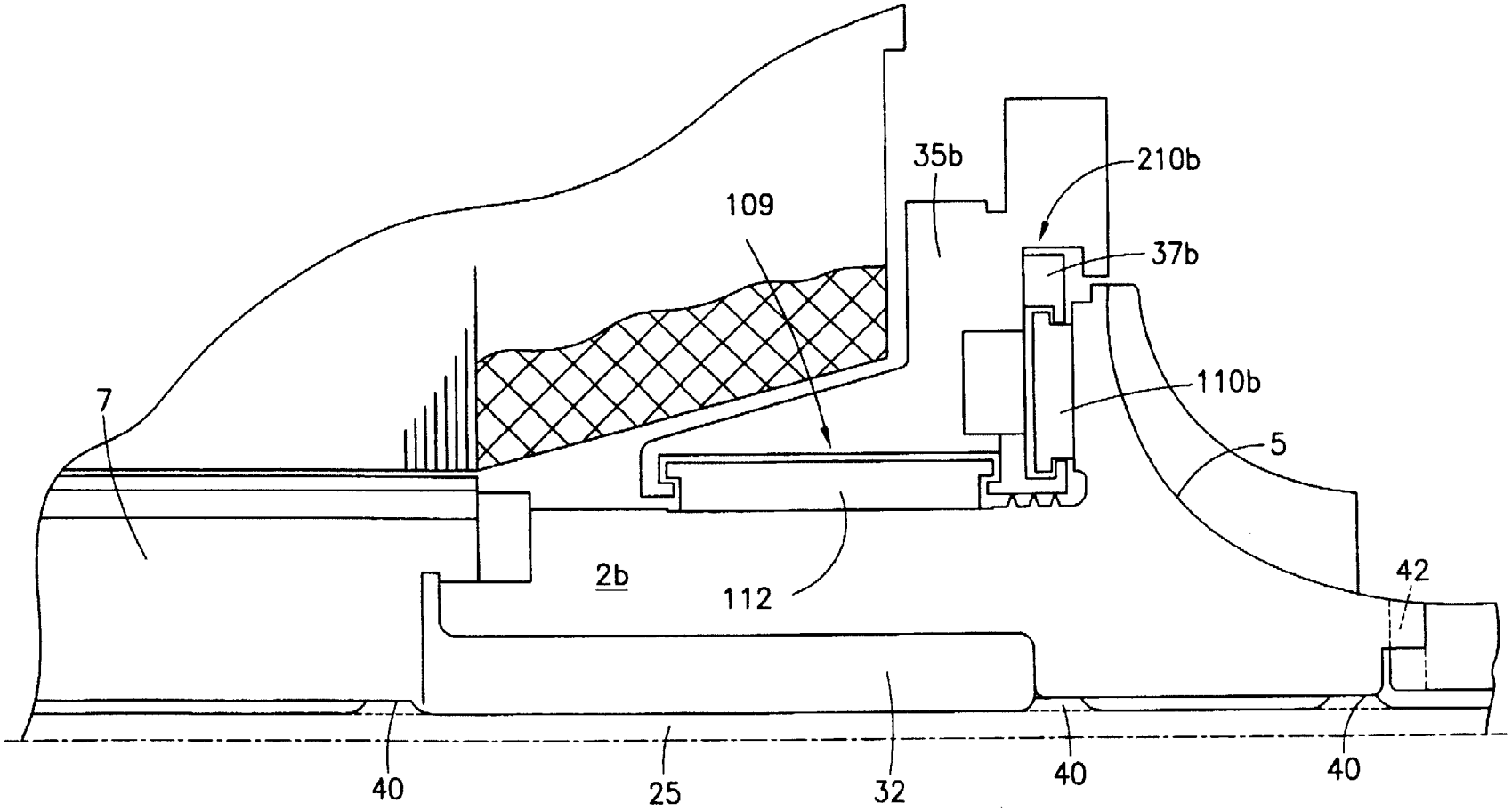
FIG. 4 is an enlarged detail of a part of the compressor of FIG. 3.

Furthermore, because of the axial hollow cylindrical cavities provided within shaft portions 2*a* and 2*b*, the moment of inertia of the composite shaft about its rotational axes is reduced which increases the efficiency of the electromagnetic motor drive. Journal bearings 108, 109 are provided at opposed ends of the shaft and have bearings 112 which act on respective shaft portions 2*a*, 2*b*. Aided by the presence of cavities 31, 32 heat generated in the shaft from bearing contact with the journal bearings is transferred directly to impeller 5, 4 where it is transferred to the working gas of the compressor. At each end of the shaft the respective thrust bearing 210*a*, 210*b* and journal bearing 108, 109 are provided in a respective common unitary housing 35*a*, 35*b*. The compressor shown in FIGS. 3 and 4 operates in an almost identical manner to the compressor shown in FIG. 1. Intercoolers (not shown) are provided intermediate each impeller rotor stage 4,5,6 and flow of working gas through the compressor is substantially as described in relation to the compressor shown in FIG. 1.

I claim:

1. A compressor comprising:

a) a rotatable shaft having spaced apart portions;

b) drive means arranged to rotate said shaft, said drive means comprising an electric motor having a rotor mounted on said shaft;

c) a plurality of impeller rotor stages mounted on respective spaced apart portions on the shaft;

d) intercooler means provided intermediate said impeller rotor stages; and e) journal bearing means for said shaft, said journal bearing means comprising at least one tilting pad journal bearing arranged to be self generating and air or gas lubricated, and having bearing pads provided with a ceramics bearing surface.

2. A compressor according to claim 1, wherein:

said impeller rotor stages are overhung at opposed ends of the shaft.

3. A compressor according to claim 1, wherein:

said impeller rotor stages are arranged in reverse formation relative to one another such that respective flows of air or gas into respective impeller stages are in opposed directions.

4. A compressor according to claim 1, wherein:

said drive means is being provided intermediately between said spaced apart portions.

5. A compressor according to claim 1, further comprising:

f) a thrust bearing arranged to act directly on at least one said impeller rotor stage.

6. A compressor according to claim 5, wherein:

said thrust bearing comprises at least one bearing member arranged to make a bearing contact with a rotating bearing face of said impeller rotor stage.

7. A compressor according to claim 6, wherein:

said thrust bearing means and said impeller rotor stage are arranged to be in thermally communicative bearing contact when said shaft is rotating.

8. A compressor according to claim 6, wherein:

two spaced impeller rotor stages are provided on said shaft, respective thrust bearings being arranged to act directly on said two spaced impeller rotor stages to take up axial forces in opposed axial directions of said shaft.

9. A compressor according to claim 1, wherein:

at least a portion of said rotatable shaft is substantially hollow.

10. A compressor according to claim 9, wherein:

said shaft comprises a composite shaft comprising a rotor portion intermediately connecting said spaced apart portions of said shaft, said spaced apart portions being provided with respective axially extending cavities.

* * * * *